US006394628B1

(12) United States Patent
Wang

(10) Patent No.: US 6,394,628 B1
(45) Date of Patent: May 28, 2002

(54) BALLAST HOUSING FOR LUMINAIRE

(75) Inventor: James P. Wang, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/511,151

(22) Filed: Feb. 23, 2000

(51) Int. Cl.[7] ..... F21V 17/00

(52) U.S. Cl. ..... 362/375; 362/267; 362/404; 362/147; 362/154; 362/226; 362/368; 362/370; 362/371; 362/396; 362/406

(58) Field of Search ..... 362/267, 404, 362/147, 154, 226, 368, 370, 371, 396, 406, 375

(56) References Cited

U.S. PATENT DOCUMENTS

| | | | | |
|---|---|---|---|---|
| 2,225,057 A | | 12/1940 | Kuntz | 362/147 |
| 2,826,684 A | | 3/1958 | Baker | 362/306 |
| 4,222,093 A | | 9/1980 | Garcia et al. | 362/147 |
| 4,327,403 A | | 4/1982 | Capostagno et al. | 362/306 |
| 4,460,947 A | | 7/1984 | Kelly | 362/374 |
| 4,507,719 A | | 3/1985 | Quiogue | 362/719 |
| 4,719,540 A | * | 1/1988 | San George et al. | 361/377 |
| 4,827,386 A | | 5/1989 | Mackiewicz | 362/267 |
| 5,463,540 A | | 10/1995 | Jones | 362/260 |
| 5,491,618 A | | 2/1996 | Vakil | 362/147 |
| 5,662,407 A | | 9/1997 | Fischer et al. | 362/147 |
| 6,116,749 A | | 9/2000 | Quiogue et al. | 362/148 |

OTHER PUBLICATIONS

Miller Lighting Catalog, Semi–Recessed Light Watt; 1981.

Hubbell Lighting, Inc. catalog pages listing UCT–5 Instruction and maintenance; Aug. 30, 1999.

Hubbell Lighting, Inc. Catalog pages listing UCT–5 Instruction and Maintenance.

* cited by examiner

*Primary Examiner*—Stephen Husar
*Assistant Examiner*—Guiyoung Lee
(74) *Attorney, Agent, or Firm*—Mark S. Bicks; Tara L. Hoffman; Alfred N. Goodman

(57) ABSTRACT

A ballast housing has a bottom wall, a sidewall extending in a first direction from the bottom wall, and a first compartment that is defined between the bottom wall and the sidewall, with a first access opening remote from the bottom wall. The housing further includes an interior wall extending from its bottom wall in the first direction and is located completely within the first compartment, and a second compartment that is defined by the interior wall and is isolated from the first compartment by the interior wall. The second compartment includes a second access opening adjacent the bottom wall. A first component can be disposed in the first compartment and a second component can be disposed in the second compartment with the second compartment isolating the second component from the first component in the first compartment.

14 Claims, 7 Drawing Sheets

BALLAST HOUSING FOR LUMINAIRE

BACKGROUND OF THE INVENTION

A luminaire is a lighting unit typically employed on a ceiling or on a lamp pole, either indoors or outdoors. The luminaire includes a ballast assembly and an optical assembly mounted to a mounting structure such as a luminaire housing door or a canopy. Specifically, the optical assembly is mounted to the ballast housing of the luminaire providing canopy-type lighting. The ballast unit has electrical components, such as a ballast. The optical assembly includes a mounting casting and a pivotally attached lens frame that supports a lens. A lamp is held within the lens and is electrically and mechanically connected to the ballast unit. Furthermore, to change the optical assembly requires uninstalling the ballast assembly Problems arise in installing and maintaining the luminaire. The prior art luminaires are commonly difficult to install requiring the use of more than one person to complete the installation. In addition, the prior art luminaires do not allow the installer or manufacturer to wire the ballast assembly prior to assembling it with the luminaire housing door, thus eliminating the option of installing the assembly from below the mounting structure. Also, performing maintenance on known luminaires is complicated because easy access into the ballast unit is not provided, and the entire assembly may have to be disassembled.

Other problems with the prior art luminares include not having the ability to easily adapt to pre-existing canopy fixtures and not providing protection for the optical assembly from the surrounding environmental elements such a moisture and dust. Also, the prior art ballast housings of the luminaires are bulky and do not efficiently organize the electrical components therein. Similarly the prior art ballast housings do not protect the heat-sensitive electrical components from the heat-emitting components, such as the lamp socket, held within the ballast housing. Furthermore, the prior art ballast housings do not provide a way to facilitate cooling of the ballast itself held within the housing. Finally, the ballast housings of the prior art luminaires have to be employed with an optical assembly that is specifically adapted to be used with that ballast housing.

SUMMARY OF THE INVENTION

Accordingly, an object of the present invention is to provide luminaire with a mounting system that facilitates installation of the optical assembly on either a luminaire housing door or a canopy fixture.

Another object of the present invention is to provide a ballast housing having dual compact compartments, an angled floor, and channels extending along the bottom of the housing for holding support rails.

A further object of the present invention is to provide a luminaire with a ballast housing that can be pre-wired and allows for easy access to the electrical components within the housing.

Yet another object of the present invention is to provide a luminaire that includes a gasket member for a weather tight seal between the ballast housing and the optical assembly.

Still another object of the present invention is to provide a luminaire that can easily adapt to existing luminaire housings and canopy fixtures and employs a generic optical assembly.

The foregoing objects are basically attained by a ballast housing comprising a bottom wall, a sidewall extending in a first direction from the bottom wall, and a first compartment that is defined between the bottom wall and the sidewall, with a first access opening remote from the bottom wall. The housing further includes an interior wall extending from its bottom wall in the first direction and is located completely within the first compartment, and a second compartment that is defined by the interior wall and is isolated from the first compartment by the interior wall. The second compartment includes a second access opening adjacent the bottom wall. A first component can be disposed in the first compartment and a second component can be disposed in the second compartment with the second compartment isolating the second component from the first component in the first compartment.

In a second embodiment, the ballast housing further includes a first channel member extending along the bottom wall of the housing. A rail member is received in the channel member and is disposed between the bottom wall of the ballast housing and the mounting member of the optical assembly.

By designing the ballast housing in this fashion, it can be easily mounted to existing luminaire housings and canopy fixtures requiring only one person to install and maintain the assembly. In addition, an optical assembly mounted to the ballast assembly can be changed without having to uninstall the ballast assembly. Also, the design of the ballast housing creates efficient space utilization resulting in a compact housing. This ballast housing protects the heat-sensitive components in the housing from the heat-emitting components while facilitating the cooling of the ballast itself.

Other objects, advantages and salient features of the invention will become apparent from the following detailed description, which taken in conjunction with the annexed drawings, discloses preferred embodiments of the invention.

BRIEF DESCRIPTION OF THE DRAWINGS

Referring to the drawings which form a part of this disclosure.

DETAILED DESCRIPTION OF THE INVENTION

Figure 1:
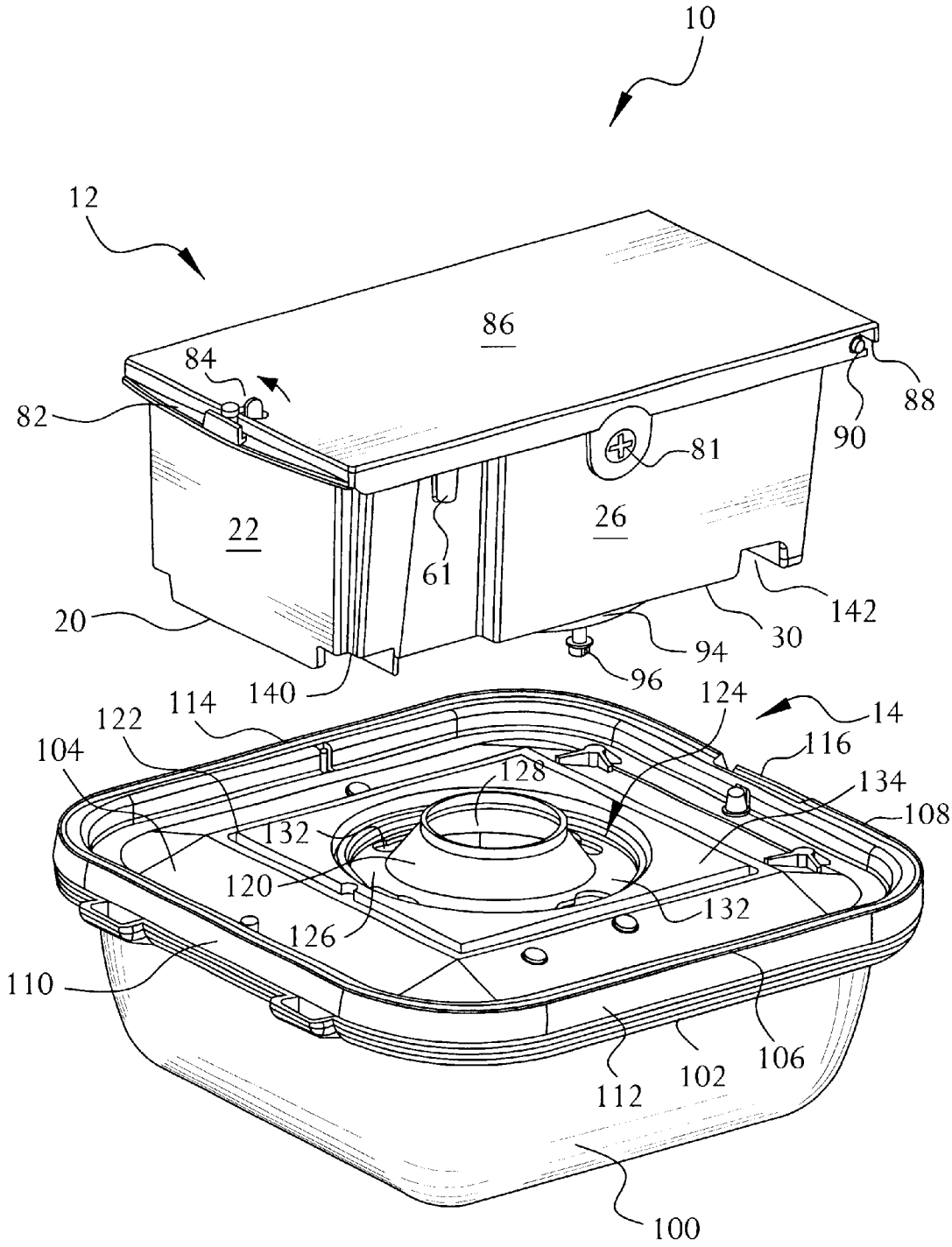
FIG. 1 is an exploded, right side perspective view of a luminaire according to an embodiment of the present invention, illustrating the ballast assembly and the optical assembly.
Figure 6:
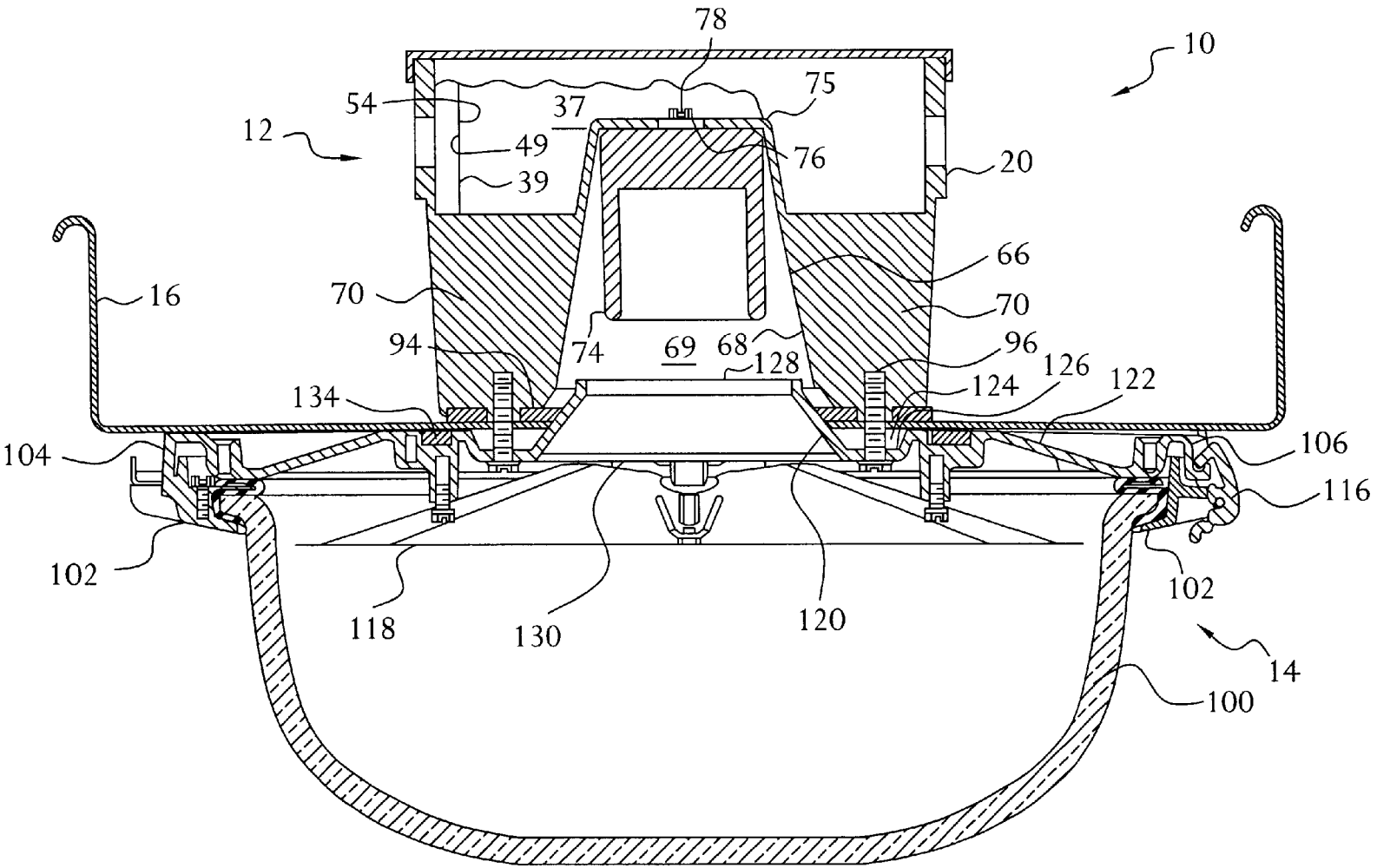
FIG. 6 is a elevational view in section of the luminaire illustrated in FIG. 5 with the ballast assembly rotated 90 degrees from its orientation in FIG. 1, showing the mounting system for assembling the ballast assembly and the optical assembly.

A luminaire 10, according to the present invention, includes a ballast assembly 12 and an optical assembly 14, as can be seen in FIG. 1. Ballast assembly 12 and optical assembly 14 are mounted together on a mounting structure 16, such as a luminaire housing door or a canopy, as best seen in FIG. 6.

Referring to FIGS. 1–4, ballast assembly 12 includes a ballast housing 20 that holds the necessary electrical components for connecting to and operating optical assembly 14. Ballast housing 20 comprises a plurality of sidewalls or wall portions, including opposing front and rear walls 22, 24 and opposing right and left walls 26 and 28, all extending from a bottom wall 30, forming a box-type housing. Right and left walls 26 and 28 incline somewhat outwardly to allow ballast housing to be easily removed from an injection mold, thus forming a slightly obtuse angle with bottom wall 30. A first compartment 32 is formed between bottom wall 30 and the sidewalls of housing 20 with a first access opening 33 defining the open top of housing 20.

First compartment 32 holds some of the electrical components required for operation of luminaire 10 including a starter 35, a capacitor 36, and a ballast 37. Starter 35 rests on bottom wall 30 proximate rear wall 24. A first upstanding support wall 40 extending from bottom wall 30 in the direction of the sidewalls of first compartment 32, supports starter 35 between it and rear wall 24, restricting the movement starter 35.

Figure 3:
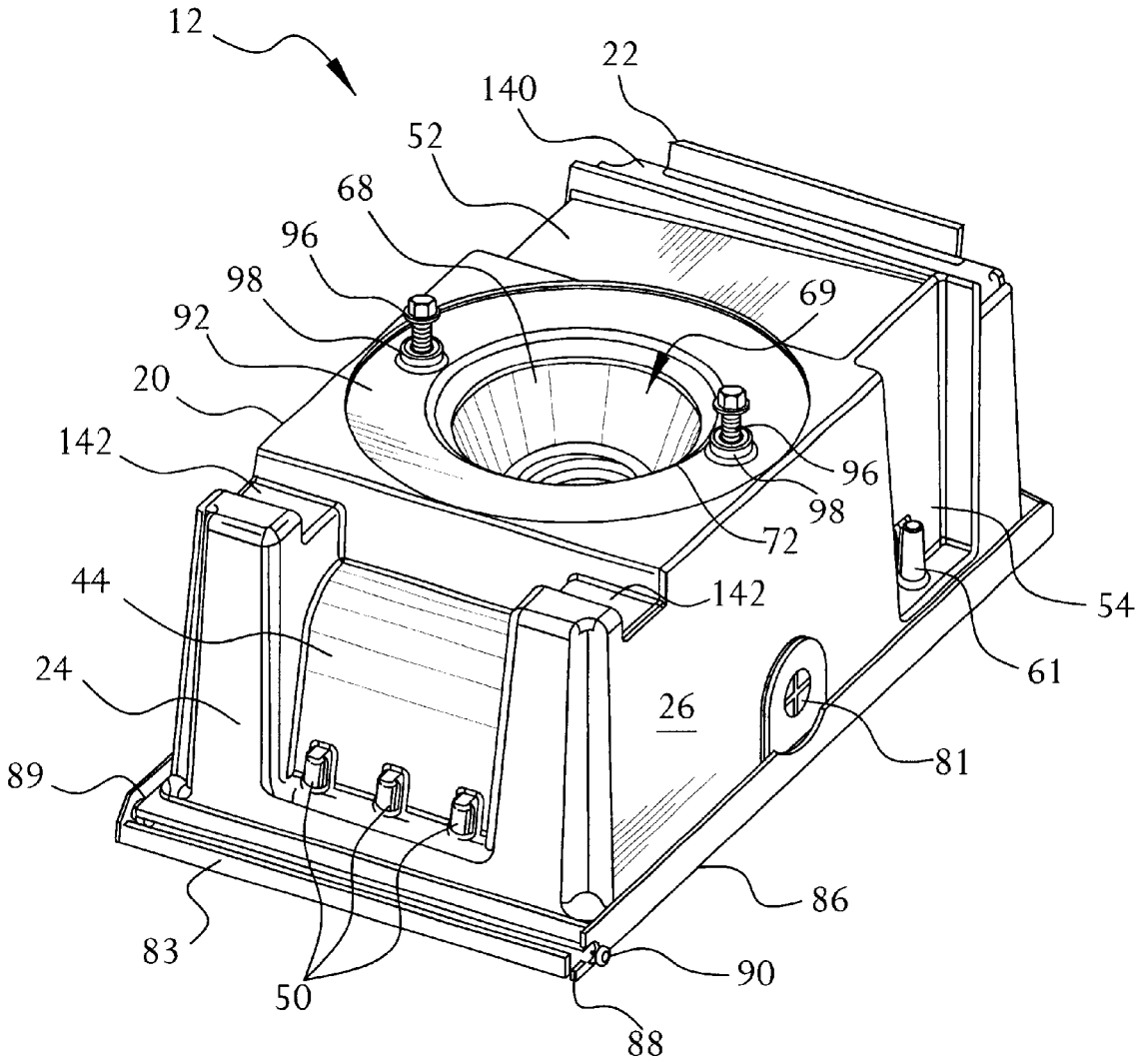
FIG. 3 is a bottom, right side perspective view of the ballast assembly illustrated in FIG. 1.

Capacitor 36 is disposed near starter 35 and is supported between a second upstanding wall 42, located in the same plane as first upstanding wall 40, and a platform 44 inset from both bottom wall 30 and rear wall 24 toward the interior of first compartment 32. Preferably, platform 44 is shaped to accommodate capacitor 36 and in particular has a sloped edge that closely conforms to capacitor 36, as best seen in FIG. 3. However, platform 44 can be of various shapes without the sloped edge or platform 44 can be eliminated such that capacitor 36 is supported between second support wall 42 and rear wall 24. For additional securement of the capacitor 36, a bracket 46 may be employed to prevent capacitor 36 from moving within first compartment 32. Specifically, on end of bracket 46 is attached to capacitor 36 and an opposing end is attached to the portion of platform 44 that is inset from rear wall 24 by one of fasteners 48. Fasteners 48 are received in fastener holes 50 formed on the outer surface of rear wall 24 proximate the inset portion of platform 44 for securing bracket 46 and for connecting starter 35 to capacitor 36.

Figure 4:
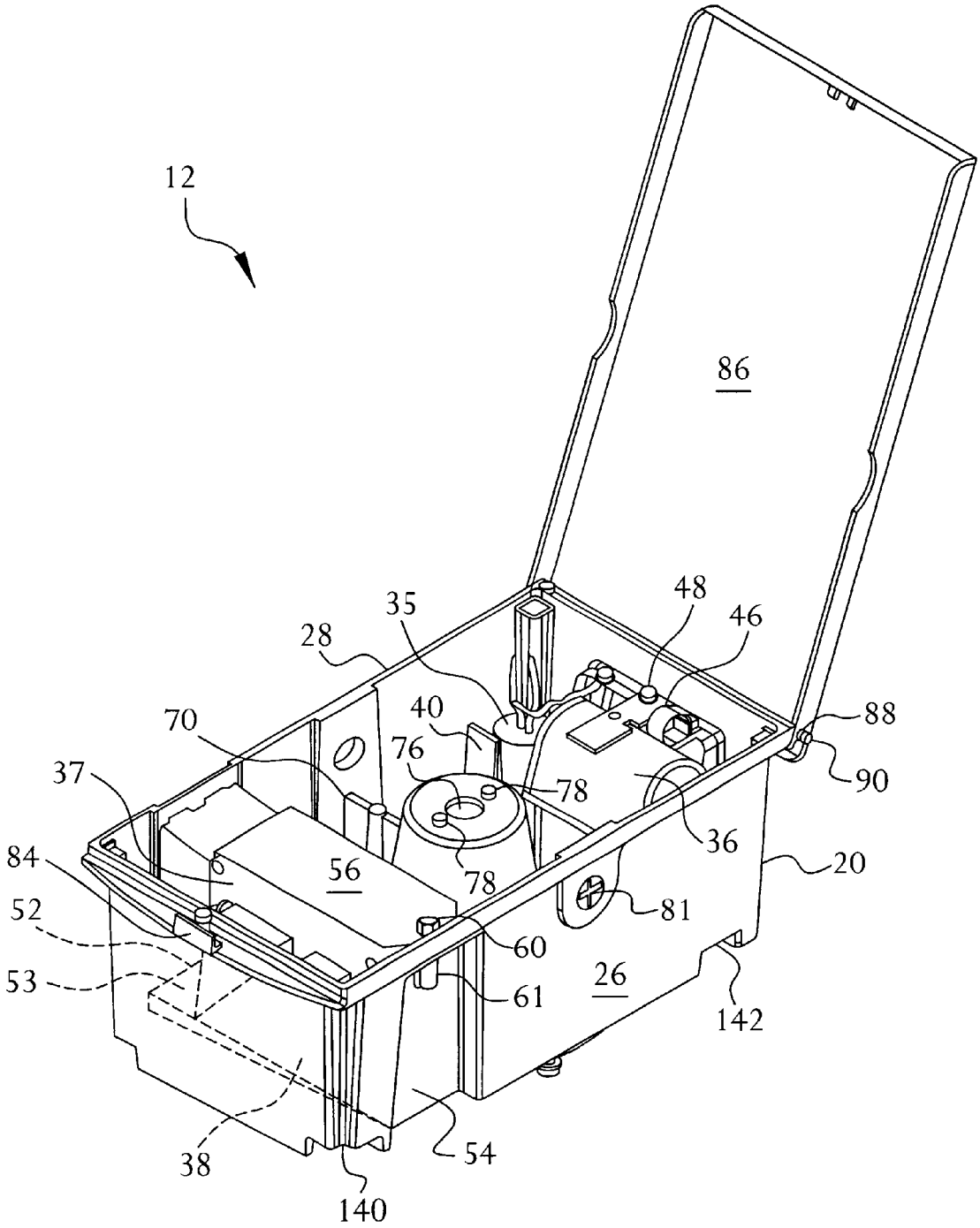
FIG. 4 is a top, right side perspective view of the ballast assembly illustrated in FIG. 1, showing the lid of the ballast housing in an open position.

Ballast 37 is disposed opposite starter 35 and capacitor 36 in first compartment 32 of housing 20 proximate front wall 22. In particular, ballast 37 rests on an angled ramp section 52 inset from bottom wall 30, as best seen in FIGS. 3 and 4. Ramp section 52 is angled downwardly from left wall 28 toward right wall 26. Since right wall 26 is slightly inclined outwardly, ramp section 26 forms a substantial right angle with right wall 26. Since ballast 37 is heavy, gravity forces ballast 37 down the ramp toward an inset right wall 26. Specifically, ballast 37 rests on the upper surface 53 of ramp section 52 and abuts an inner support surface inset from right wall 26 in the same manner as platform 44. As a result, the entire bottom or first surface 38 of ballast 37 abuts ramp section 52 and die entire end or second surface 49 of ballast 37 abuts support surface 54 of right wall 26. By ensuring that ballast 37 contacts two surfaces of housing 20 simultaneously rather than just one, the heat of ballast 37 transfers faster to those two surfaces thus cooling ballast 37. Although, it is preferable that support surface 54 be inset from right wall, it can be planar with respect to the inner surface of right wall 26.

A plate 56 is provided to secure ballast 37 within first compartment 32 and to further ensure that ballast 37 is in contact with both ramp section 52 and support surface 54. Specifically, plate 56 extends across first opening 34 traverse to the length of housing 20 and covers the top or third surface 57 of ballast 37. Plate 56 preferably has a width approximately the same as the width of ballast 37 and is substantially planar except for a shoulder wall 58.

To attach plate 56 to housing 20, tongue elements 62, which extend from one end of plate 56, are inserted into slots 64 disposed in left wall 28 opposite inset support surface 54 to pivotally and separably attach plate 56 to left wall 28 of housing 20. A fastener 60 is then extended through an opposing end of plate 56 and into fastener hole 61 disposed within the inset portion of right wall 26 on the outer surface of right wall 26, securing plate 56 onto housing 20. Shoulder wall 58 covers end or fourth surface 59 of ballast 37 remote from right wall 26 thus preventing ballast 37 from moving within housing 20. Plate 56 can be coupled to housing 20 by any known attachment means as long as ballast 37 is secured within housing 20.

Although it is preferable that ballast 37 be located near front wall 22, and that starter 35 and capacitor 36 be located near rear wall 24, these electrical components can be disposed near any sidewall of housing 20 in the same manner as described above, as long as starter 35 and capacitor 36 are remote from ballast 37. Housing 20 is preferably formed of any material that has a good heat transfer rate, such as aluminum.

Referring to FIGS. 1–6, housing 20 further includes an interior wall 66 that extends from bottom wall 30 in the direction of the sidewalls of housing 20 forming a mounting cone that mates with a portion of optical assembly 14. A second compartment 68 is formed between interior wall or mounting cone 66 and bottom wall 30 defining an inner area 69 within mounting cone 66. Mounting cone 66 extends completely within housing 20 such that second compartment 68 is disposed entirely within first compartment 32. A bracing wall 70 extends laterally from mounting cone 66 to right and left walls 26 and 28 providing support for housing 20 and mounting cone 66.

The bottom end mounting cone 66 and second compartment 68 is open defining a second access opening 72 that receives a lamp socket 74. The top end 75 of mounting cone 66 is substantially planar with a diameter smaller than that of second access opening 72. An aperture 76 is centrally disposed in top end 75 allowing socket leads 77 of socket lamp 74 to pass through to first compartment 32 from second compartment 68 for connection to the electrical components held therein. Lamp socket fasteners 78 are employed to secure lamp socket 74 within mounting cone 66 and second compartment 68. Specifically, fasteners 78 are extended into a top portion of lamp socket 74 such that lamp socket 74 is held high within second compartment 68 abutting the lower surface of top end 75. The high profile of lamp socket 74 within second compartment 68 allows housing 20 to be more compact.

By designing housing 20 with a dual chamber, such that second compartment 68 is disposed completely within first compartment 32, allows for efficient space utilization and a compact housing. Specifically, all of the electrical components are held within one compact compartment 32 while lamp socket 74, by being held within second compartment 68, is isolated from the other electrical components, thus protecting the heat-sensitive electrical components, such as capacitor 36, from the heat-emitting lamp socket 74. In addition, the design of housing 20 allows the installer or manufacturer to wire all of the electrical components within ballast assembly 12 at the factory prior to installation because lamp socket 74 is disposed in ballast housing 20 rather in optical assembly 14. Furthermore, this allows a generic optical assemblies to be employed with different wattage ballast assemblies.

Figure 2:
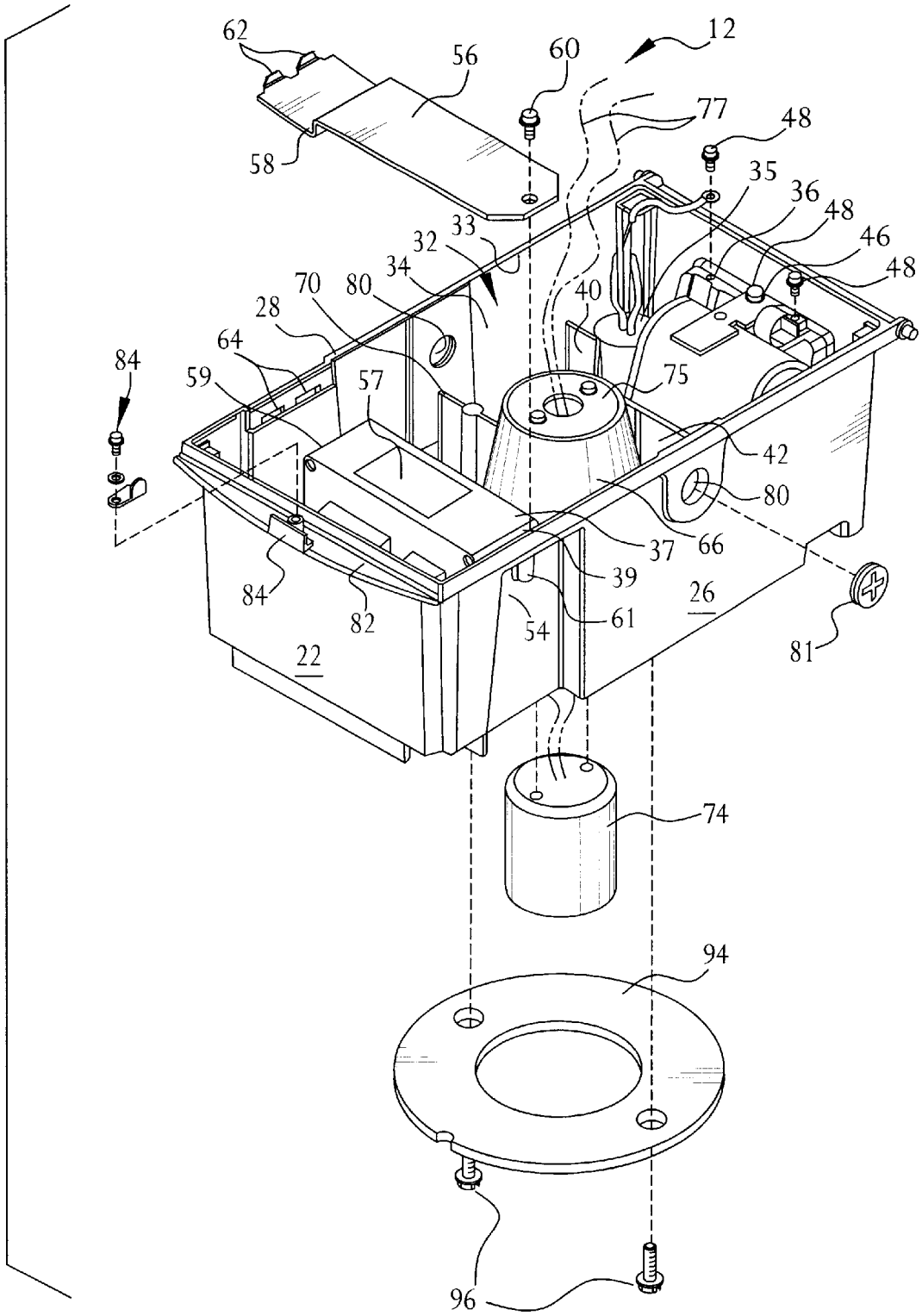
FIG. 2 is an exploded, right side perspective view of the ballast assembly illustrated in FIG. 1.

Housing 20 also includes wire entry holes 80 generally centrally disposed on each of right and left walls 26 and 28, as seen in FIGS. 2 and 4 for receiving wires from an electrical source, and can be closed with a closing screw 81. Flange or handle portions 82 and 83 extend preferably from front and rear walls 22 and 24, respectively, providing the installer with a handle to facilitate lifting and moving ballast assembly 12. Handle portions 82 and 83 can extend from any of the sidewalls of housing 20 and thus is not limited to extending from only front and rear walls 22 and 24. A latch 84 is centrally disposed on handle portion 82 for engaging a lid 86 that covers and closes first access opening 34 of first compartment 32. Latch 84 simply rotates from being located over lid 84 in a latched position to being clear of lid 84 in a released position. As seen in FIGS. 1 and 4, lid 86 has a pin 88 and a pin hole 89 each located at opposite sides of one end of lid 86 which are coupled to corresponding hinge pins 90 extending from housing 20 proximate rear wall 24 allowing lid 86 to pivot between open and closed positions. Although it is preferable that lid 86 be hingedly coupled to rear wall 24, lid 86 can be oriented in any manner with respect to housing 20 as long as lid 86 is hingedly coupled to one sidewall of housing 20 and engages latch 84 at an opposite sidewall of housing 20.

Figure 5:
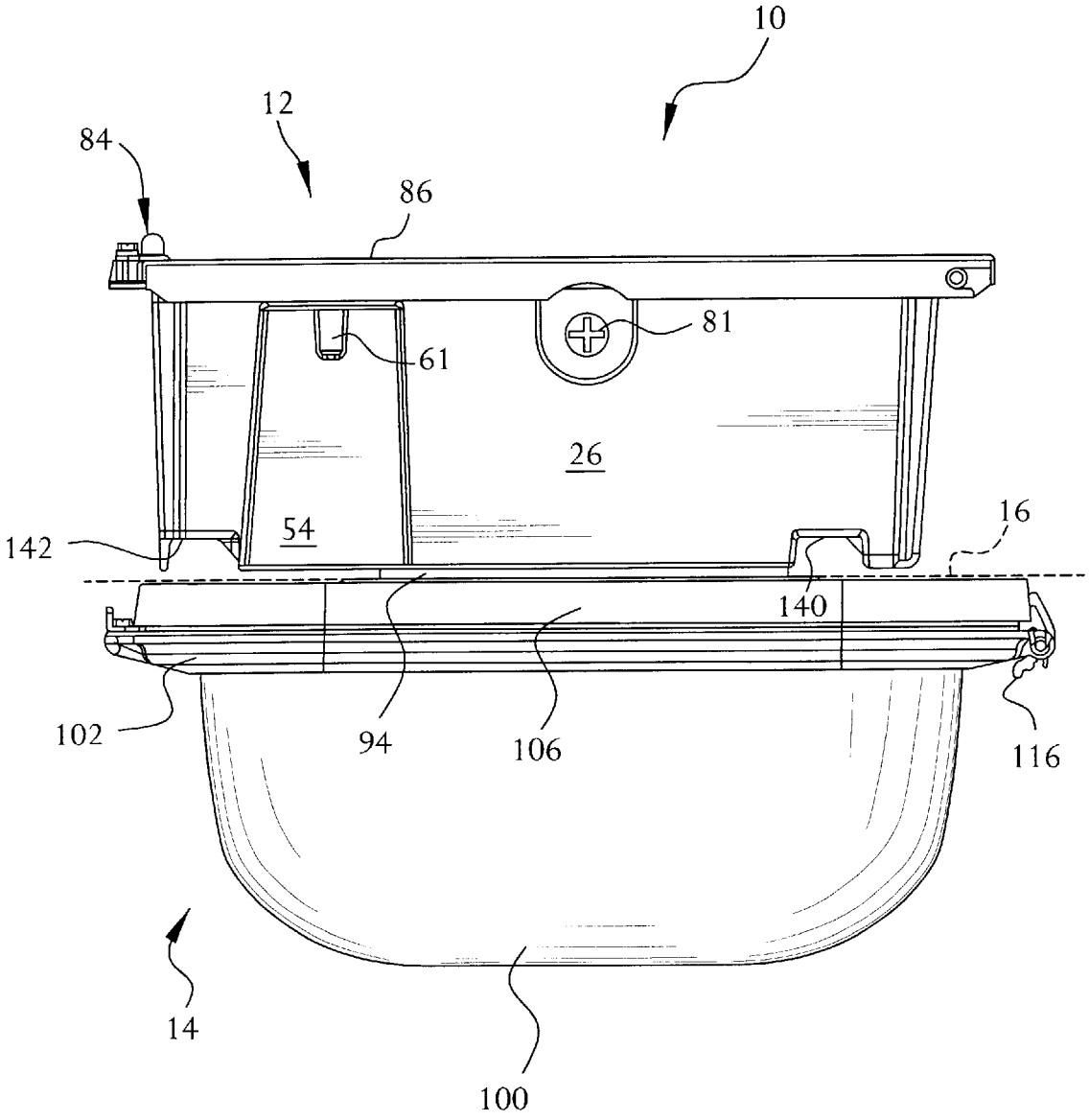
FIG. 5 is a right side elevational view of the luminaire illustrated in FIG. 1, showing the ballast assembly and optical assembly assembled.

Ballast assembly 12 and housing 20 include a mounting system that corresponds to a mounting system on optical assembly 14 allowing the two units to be assembled on mounting structure 16, as seen in FIGS. 5 and 6. In general, the mounting system of ballast housing 20 includes the mounting cone 66 which receives a portion of optical assembly 14 and securing members 96 which correspond to securing members on optical assembly 14.

Specifically, housing 20 includes a concentric gasket track 92 in bottom wall 30 disposed around second opening 72 of mounting cone 66. A top gasket 94 is located within track 92 providing a seal between ballast assembly 12, mounting structure 16, and optical assembly 14 when assembled, as best seen in FIG. 5, for protection against moisture and dirt from above mounting structure 16. Track 96 further includes mounting bolts or first securing members 96 which extend through gasket 94 and bottom wall 30 of housing 20 for engaging optical assembly 14. Each of the mounting bolts 96 can include self-centering cones 98 disposed between gasket 94 and the head of the mounting bolt. Specifically, to engage optical assembly 14, mounting bolts 96 extend through apertures in canopy 16 and self-centering cones 98 follow by resting in those apertures thus centering the ballast assembly 12 onto mounting structure 16. However, it is not necessary to employ the self-centering cones 98 with the mounting bolts 96 for the mounting system of ballast housing 20 to be operative.

Referring to FIGS. 1–6, optical assembly 14 comprises a lens 100, a lens frame 102 for supporting lens 100, and a mounting member 104 pivotally connected to frame 102, as best seen in FIG. 6. A receiving shoulder 106 is disposed around mounting member 104 for receiving lens frame 102 having opposing front rear wall portions 108 and 110 and opposing right and left wall portions 112 and 114. An automatic spring latch 116 is disposed on lens frame 102 for locking and unlocking mounting member 104 with respect to lens frame 102. In addition a reflector 118 extends downwardly from mounting member 104 within lens 100.

The mounting system of optical assembly 14 generally includes a mounting extension or lead-in cone 120 extending from the upper surface 122 of mounting member 104 remote from lens 100. A central recessed portion 124 is disposed in upper surface 122 with lead-in cone 120 located within recessed portion 124 defining a concentric mounting track 126 around cone 120. Lead-in cone 120 includes an access or third opening 128 at its top end that corresponds to second opening 72 of housing 20. A fourth opening 130 located at the bottom end of lead-in cone 120 remote from third opening 128 and having a diameter larger than that of third opening 128, provides access to second opening 72 through mounting member 104. A lamp (not shown) can then be extended through lead-in cone 120 and connected to lamp socket 74 and remain suspended within the interior area of lens 100 and optical assembly 14. Lead-in cone also functions as a reflector to help redirect light from the lamp downward. Mounting key holes or second securing members 132 are concentrically disposed within track 126 for receiving mounting bolts 96 of ballast housing 20. Also a second or bottom gasket 134 can be used on upper surface 122 of mounting member 104 to provide an additional seal between ballast assembly 12, mounting structure 16 and optical assembly 14 from below mounting structure 16.

To assemble ballast assembly 12 and optical assembly 14 together on mounting structure 16, mounting bolts 96, as mentioned above, arc extended through corresponding first apertures in mounting structure 16 until the bottom surface of bottom wall 30 and gasket 94 abuts the upper surface of mounting structure 16 such that ballast assembly 12 rests on top of mounting structure 16, as seen in FIGS. 5 and 6. Alternatively, ballast assembly 12 can be installed from below mounting structure 16 by inserting the ballast assembly 12 through a central or second aperture in mounting structure 16 in a vertical position. Once, ballast assembly 12 has passed through the central aperture, it is rotated to a horizontal position and rested on mounting structure 16 such that bottom wall 30 abuts the top surface of mounting structure 16 and mounting bolts 96 extend downwardly through the central aperture. In FIG. 6, ballast assembly 12 is shown rotated 90 degrees from its orientation in FIG. 5 to more clearly show how ballast assembly 12 and optical assembly 14 are connected.

Optical assembly 14 can then be mounted to ballast assembly 12 by a bayonet connection. Specifically, mounting bolts 96 are extended through key holes 132 in mounting member 104 and optical assembly 14 is rotated until the heads of mounting bolts 96 catch on the ends of key holes 132 thus suspending optical assembly 14 from ballast assembly 12 with mounting structure 16 disposed therebetween. In addition, lead-in cone 120 of optical assembly 14 is inserted through the central aperture in mounting structure 16 and into inner area 69 of mounting cone 66 centering optical assembly 14 with respect to ballast assembly 12. Lens 100 and lens frame 102 of optical assembly 14 is then opened by releasing latch 116 and pivoting lens frame 102 downwardly providing access to mounting bolts 96 extending through mounting member 104. Mounting bolts 96 can then be tightened until lead-in cone 120 abuts the sides of the second aperture in mounting structure 16 and gasket 94, as best seen in FIG. 6, securing optical assembly 14 to the bottom of mounting structure 16 and ballast assembly 12. A lamp is then installed through lead-in cone 120 of optical assembly 14 and connected to lamp socket 74 disposed in mounting cone 66 of ballast assembly 12. The lens 100 and lens frame 102 are then pivoted back to a closed position upon which latch 116 re-engages mounting member 104.

It is preferable that ballast assembly 12 is oriented with respect to optical assembly 14 as shown in FIG. 5, however, ballast assembly 12 can be rotated in any position with respect to optical assembly 14 once mounted to optical assembly 14, as shown in FIG. 6.

The mounting system as described above facilitates installation of luminaire 10 on mounting structure 16 by allowing ballast assembly 12 to be pre-wired and requiring only one person to mount the assembly through a bayonet connection. In addition, maintenance of luminaire 10 is facilitated by the design of ballast housing 20 since the electrical components held therein are easily accessed through a tool-less entry lid 86. Also, optical assembly 14 can be easily removed and replaced without having to uninstall ballast assembly 12.

Figure 7:
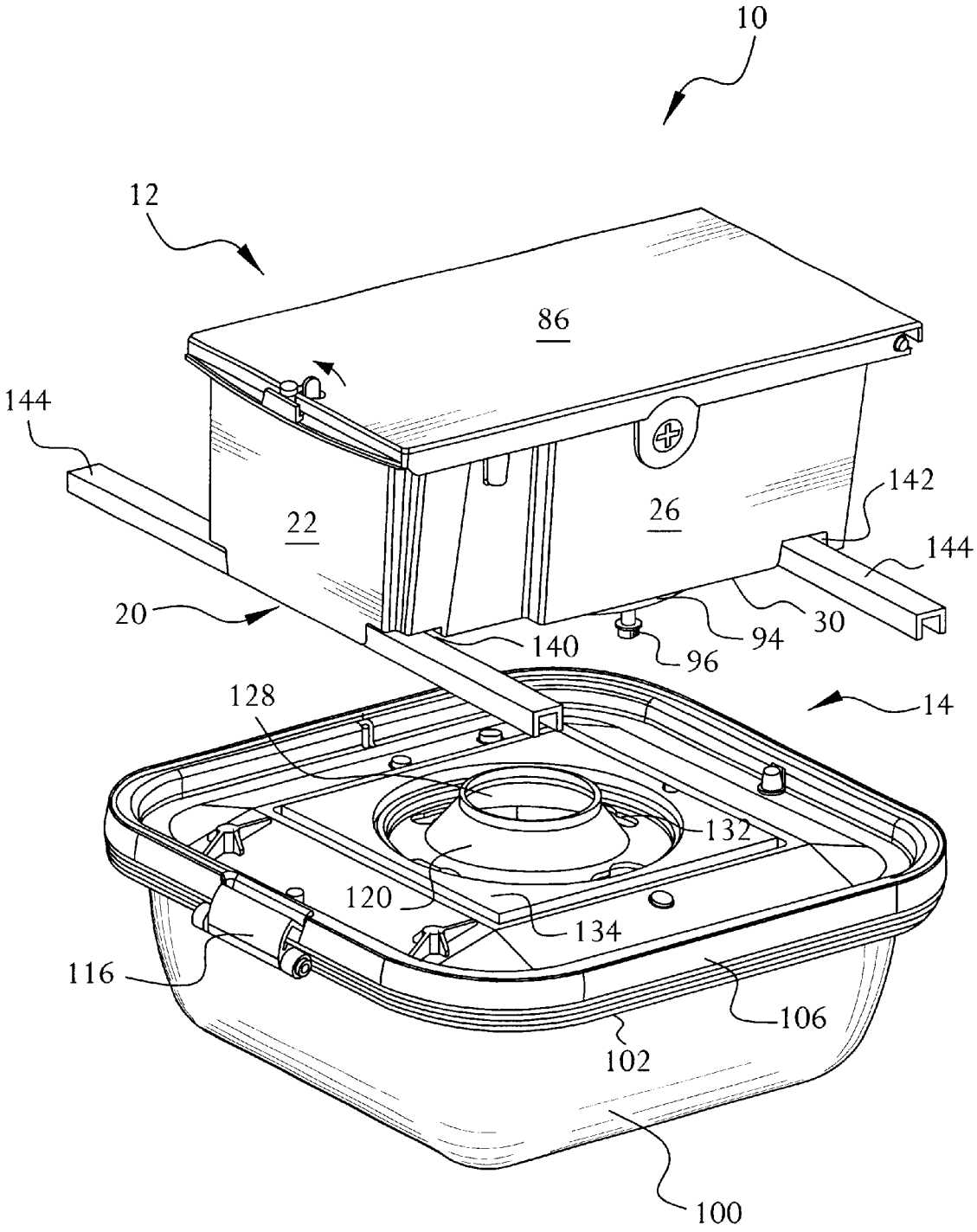
FIG. 7 is an exploded, right side perspective view of a luminaire according to a second embodiment of the present invention.

FIG. 7 illustrates a second embodiment of the luminaire 10 that easily adapts to existing mounting structures, especially when the central aperture of the mounting structure is larger than the ballast assembly. Optical assembly 14 is shown in an orientation rotated 180 degrees from its orientation in FIG. I to further illustrate that ballast assembly 12 and optical assembly 14 can be oriented in several different ways with respect to each other. To solve this problem, ballast housing 20 includes first and second channels 140 and 142 that extend along bottom wall 30 traverse to the length of housing 20, as seen in FIG. 3. Specifically, channel 140 is located between front wall 22 and ramp section 52 of bottom wall 30, and channel 142 is located between track 92 of bottom wall 30 and platform 44 of rear wall 24. The depths of channels 140 and 142 are dimensioned to receive rail members 144.

Upon mounting ballast assembly 12 upon mounting structure 16 in the manner described above, rail members 144 rest on the top surface of mounting structure 16 traversing the aperture that is larger than the ballast assembly 12. The ballast assembly 12 is then mounted on top of rail members 144 such that rail members 144 are received in channel 140 and 142, respectively, with the bottom of rail members 144 being flush with bottom wall 30 of ballast housing 20. Optical assembly 14 can then be mounted to ballast assembly 12 in the same fashion as described above. This allows luminaire 10 to adapt to any existing canopy whether the central aperture of the mounting structure is smaller or larger than ballast assembly 12. In addition, rail members 144 provide reinforcement for mounting structure 16 and luminaire 10.

While particular embodiments have been chosen to illustrate the invention, it will be understood by those skilled in the art that various changes and modifications can be made therein without departing from the scope of the invention as defined in the appended claims.

What is claimed is:

1. A luminaire, comprising:

a housing including, a bottom wall having a plurality of mounting bolts extending outwardly therefrom, a sidewall extending in a first direction from said bottom wall, a first compartment defined between said bottom wall and said sidewall, with a first access opening remote from said bottom wall, an interior wall extending from said bottom wall in said first direction and located completely within said first compartment, and a second compartment defined by said interior wall having an inner area, with a second access opening adjacent said bottom wall providing access to said inner area; and an optical assembly including a mounting member mounting said optical assembly onto said housing, said mounting member having, a mounting extension corresponding in shape to said second compartment of said housing and received in said inner area of said second compartment centering said optical assembly with respect to said housing, with a third opening disposed at a distal end of said mounting extension that corresponds to said second opening of said housing, and mounting key holes disposed proximate said mounting extension receiving said mounting bolts of said housing forming a bayonet connection securing said housing to said optical assembly, whereby said third opening of said optical assembly provides access to said housing through said second opening of said second compartment of said housing.

2. A luminaire according to claim 1, wherein said interior wall of said housing and said mounting extension of said optical assembly are substantially cone-shaped.

3. A luminaire according to claim 1, wherein said sidewall of said housing includes a plurality of wall portions forming an open box-shaped housing.

4. A luminaire according to claim 1, wherein said bottom wall of said housing includes a concentric gasket track disposed around said second opening having a gasket disposed therein with said mounting extension abutting said gasket providing a seal between said housing and said optical assembly.

5. A luminaire according to claim 1, wherein each of said mounting bolts of said housing having a self-centering cone located proximate said bottom wall of said housing.

6. A luminaire according to claim 1, wherein a lid is pivotally attached to said sidewall substantially closing said first access opening.

7. A luminaire according to claim 1, wherein said mounting member includes a fourth opening disposed opposite said third opening of said mounting extension, allowing access to said housing through said mounting member.

8. A luminaire according to claim 1, wherein said mounting extension is disposed in a recessed portion of said mounting member forming a concentric mounting track around said mounting extension.

9. A luminaire according to claim 8, wherein mounting keys holes are located in said mounting track.

10. A luminaire according to claim 1, wherein said housing is disposed above said optical assembly, and said mounting member is disposed on a top portion of said optical assembly.

11. A luminaire, comprising:

a housing including, a bottom wall having a first securing member and a first channel extending along an outer surface thereof, a sidewall extending in a first direction from said bottom wall, a first compartment defined between said bottom wall and said sidewall, with a first access opening remote from said bottom wall, an interior wall extending from said bottom wall in said first direction and located completely within said first compartment, and a second compartment defined by said interior wall having an inner area, with a second access opening adjacent said bottom wall providing access to said inner area;

a first rail member received in said first channel of said housing; and an optical assembly including a mounting member mounting said optical assembly onto said housing, said mounting member having, a mounting extension corresponding in shape to said second compartment of said housing and received in said inner area of said second compartment centering said optical assembly with respect to said housing, with a third opening disposed at a distal end of said mounting extension that corresponds to said second opening of said housing providing access therein, and a second securing member disposed proximate said mounting extension engaging said first securing member securing said housing to said optical assembly, whereby said first rail member being disposed between said mounting member of said optical assembly and said bottom wall of said housing.

12. A luminaire according to claim 11, wherein said housing includes a second channel extending along said outer surface of said bottom wall, and a second rail member received in said second channel.

13. A luminaire according to claim 12, wherein said first and second channels extend traverse to the length of said bottom wall.

14. A luminaire according to claim 11, wherein said first securing member includes a plurality of mounting bolts, and said second securing member includes a plurality of mounting key holes receiving said mounting bolts.

* * * * *